United States Patent [19]

Lin

[11] Patent Number: 4,831,927

[45] Date of Patent: May 23, 1989

[54] PRINTING PRESS DAMPENER

[75] Inventor: Jiing-Kang Lin, Woodridge, Ill.

[73] Assignee: Rockwell International Corporation, Pittsburgh, Pa.

[21] Appl. No.: 200,261

[22] Filed: May 31, 1988

[51] Int. Cl.[4] ..... B41L 25/06

[52] U.S. Cl. ..... 101/148; 101/366

[58] Field of Search ..... 101/147, 148, 366, 425

[56] References Cited

U.S. PATENT DOCUMENTS

| | | | |
|---|---|---|---|
| 2,543,663 | 2/1951 | Marsden | 101/147 |
| 3,139,028 | 6/1964 | Huebner | 101/147 |
| 4,034,670 | 7/1977 | Zavodny | 101/364 X |
| 4,044,674 | 8/1977 | Smith, Jr. | 101/148 |

*Primary Examiner*—Edgar S. Burr

*Assistant Examiner*—James Lisehora

[57] ABSTRACT

Printing dampener apparatus including a spray bar with a plurality of spray nozzle. A pair of pivoted elongated spray shields confines the lateral extent of the spray and a pair of sliding spray baffles confines the longitudinal extent of the spray.

12 Claims, 3 Drawing Sheets

PRINTING PRESS DAMPENER

This invention relates to presses that utilize the offset lithographic printing process and more particularly to improved spray rail means for supplying dampening fluid to the press during printing operations.

The process of lithographic printing involves the use of thin, flexible printing plates that are essentially planar, tht is without any relief to distinguish between the areas to be printed and those that are not to be printed. Printing by lithography involves the simultaneous utilization of fluids that are mutually incompatible. For example, large web fed presses such as those used to produce newspapers and the like commonly use oil-base inks as the print medium and a water base dampening fluid as the isolating medium. When the printing plates are exposed and etched some areas preferentially attract the oil-base liquid while others are more preferential to the water-base liquid.

In order for a printing process to meet commercially acceptable standards, it is therefore necessary that a continuous, even supply of dampening fluid be supplied to the press during the printing operation. In the past, dampening fluid, or water, since it is the principal dampening fluid, has been supplied by means of rolls partially immersed in a fountain, by means of flicker brushes and also by means of spray nozzles. Regardless of the water source the water almost always is deposed into a dampener/roll train rather than directly onto the plate roll. This method of application is to even out variations in the thickness of water film being supplied to the plate, since the uneven application of water will cause undesirable results in the printed product.

While water is essential to lithographic printing, it causes operational and maintenance problems due at least in part to its corrosive nature with respect to the printing apparatus. Thus the apparatus exposed to water should be as limited as possible and the apparatus, most desirably should be readily accessible for cleaning.

An example of a press dampening system which utilizes a plurality of spray nozzles is that shown in U.S. Pat. No. 4,044,674. In this patent, there are provided a plurality of spray nozzles 68 which are attached to the spray bar 61. The spray bar and the nozzles are confined within front and rear shields 78 and 79 and the end shields 60. In this construction, the water is sprayed onto the dampener rolls 29 and 30 and ultimately make their way through the dampener train to the plate roll 3.

In another type of dampening system, there is shown in U.S. Pat. No. 4,034,670 the use of a supply roller 13 which is contact with a feed roller 14. In this instance the feed roller is rotated at a higher speed than is the feed roller 13 so that water is removed from the surface of 13 and thrown against the dampener roll 12. The opening in the housing 42 is adjustable by means of the baffle 46.

Other constructions in which attempts are made to control the dampener spray coming from dampening apparatus onto a damper roll in a lithographic type press can be found in U.S. Pat. Nos. 2,543,663 and 3,139,028.

It is a principal object of this invention to provide a dampener spray rail for a lithographic press that is easily cleaned and maintained.

Another object of this invention is to provide a printing press dampener spray rail that can be easily and quickly mounted and demounted from the press.

A further object of this invention is to provide an improved press spray rail that has spray shields that are pivotable between operating and non-operating positions and which are quickly removable.

Still another object of this invention is to provide a press spray rail whose angular orientation can be varied with respect to the press dampener roll.

Other objects and advantages of this invention will be in part obvious and in part explained by reference to the accompanying specification and drawings, in which.

DESCRIPTION OF THE PREFERRED EMBODIMENT

Figure 1:
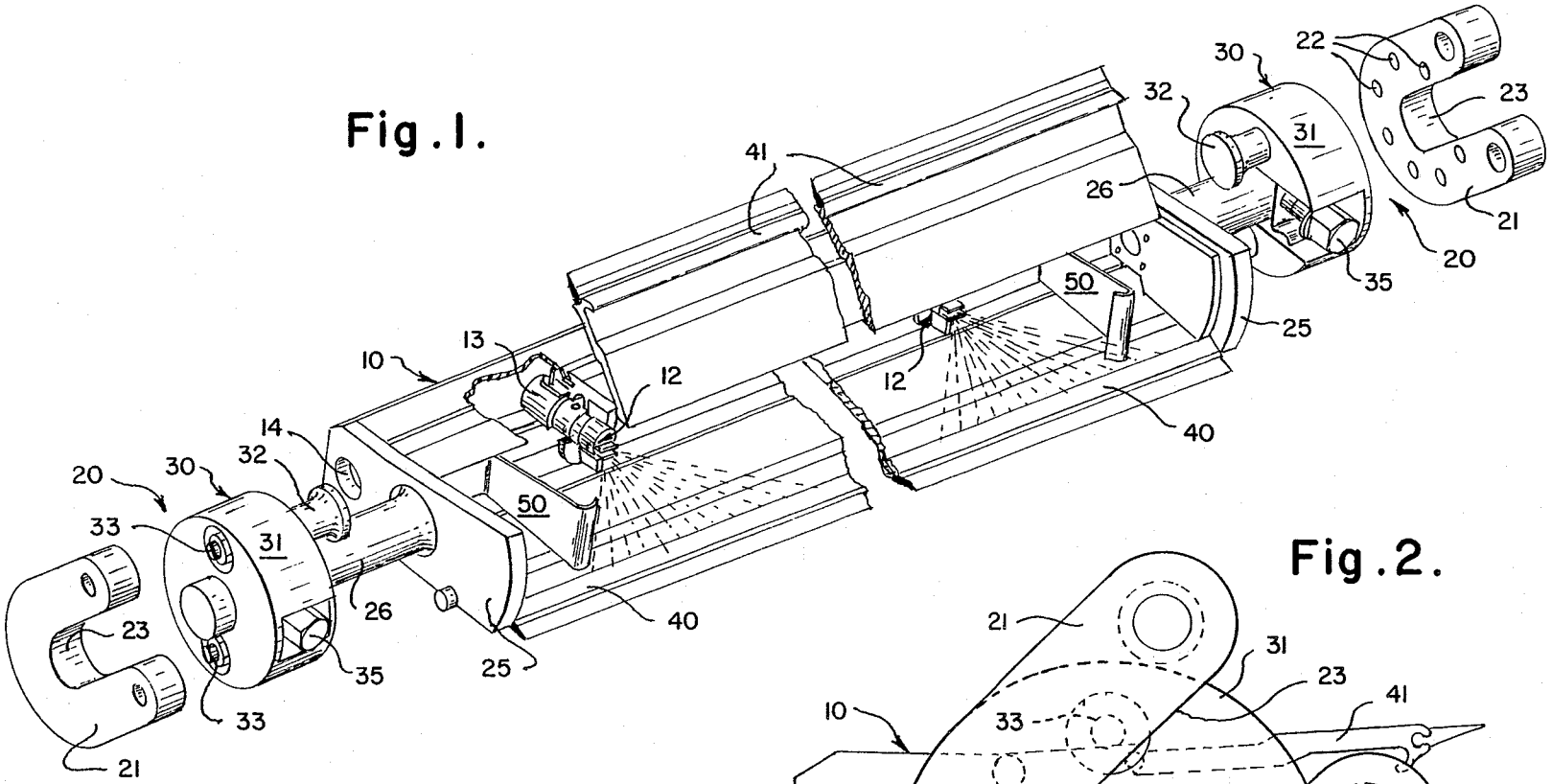
FIG. 1 is an exploded perspective of the dampener rail of this invention with a portion broken away.
Figure 3:
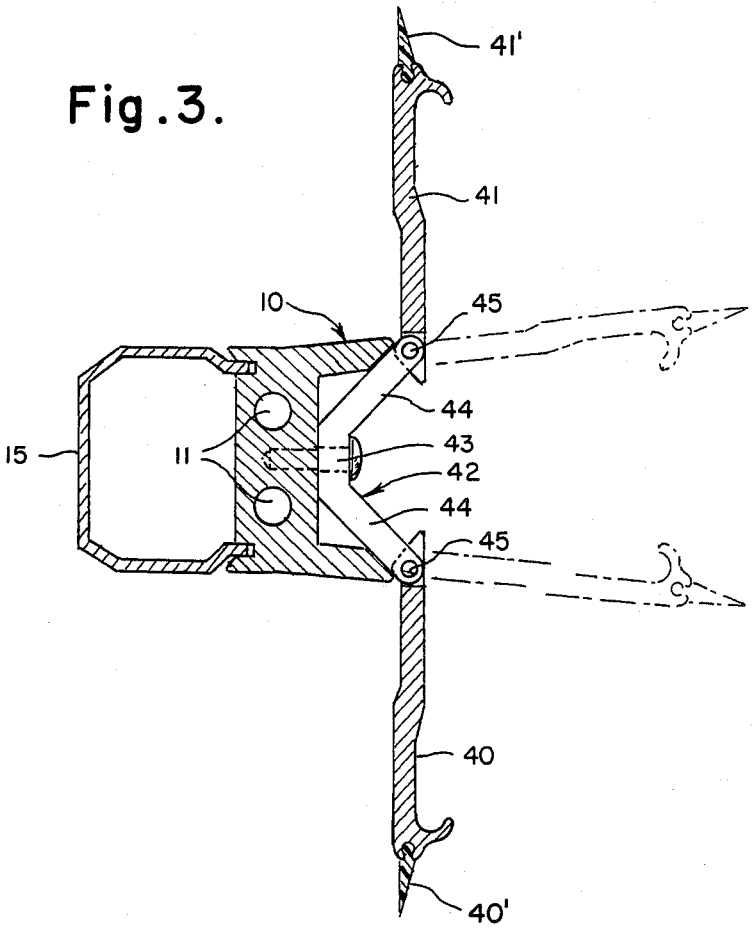
FIG. 3 is a section through the spray bar showing the spray shields.
Figure 6:
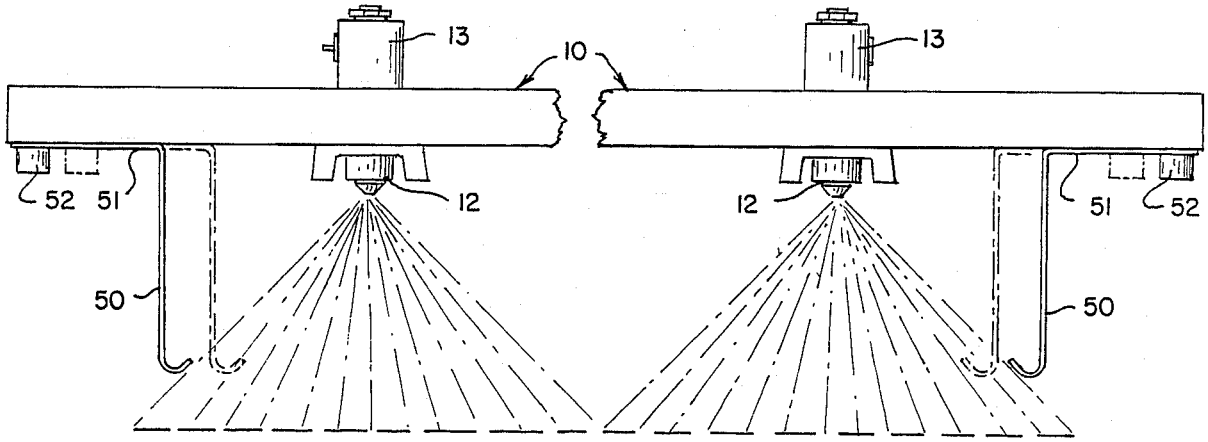
FIG. 6 is a somewhat diagrammatic top plan view of a dampener rail showing secondary spray baffles on the ends of the rail.
Figure 4:
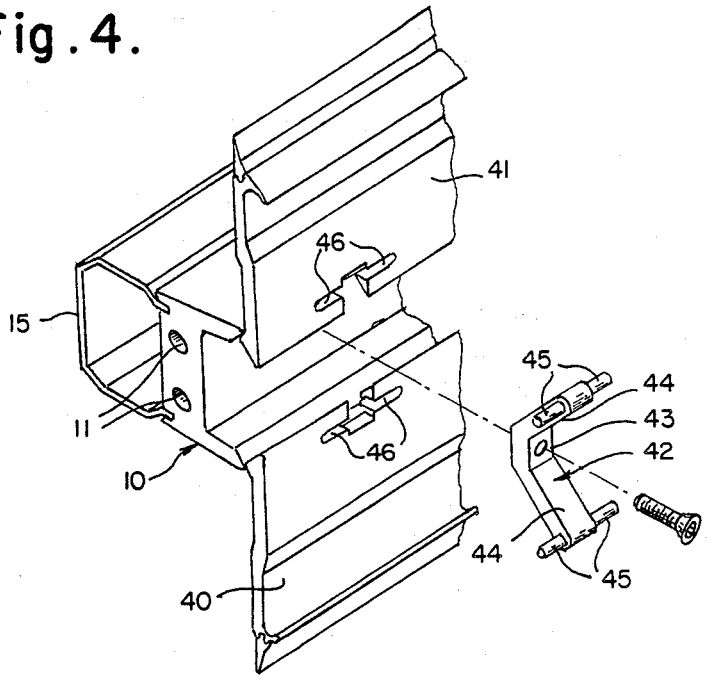
FIG. 4 is an exploded perspective of the hinge construction of the invention.
Figure 5:
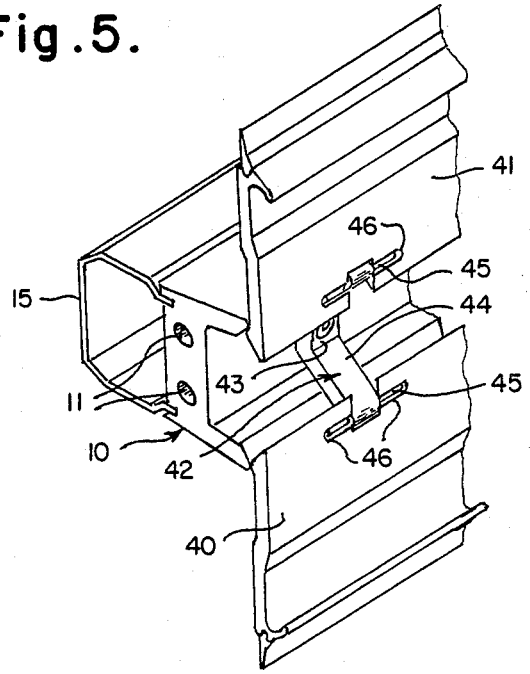
FIG. 5 is a view similar to FIG. 4 showing the spray shield mounting bracket in assembled condition.

For a better understanding of the present invention, reference is made to the drawings and more particularly to FIG. 1 wherein the numeral 10 indicates an elongated body means that has a fluid passages 11 (FIGS. 3–5) provided therein for connection to a supply of dampening fluid, the supply of dampening fluid not being shown. Along the length of the elongated body means 10 and in communication with the fluid passage 11 are a plurality of spray nozzle means 12 that are in communication with the fluid passages and are used to spray dampening fluid against a dampener roll. The nozzles may be of any desired type but in the present case are indicated as being solenoid operated nozzles which function by being connected to a source of fluid pressure and opened intermittently according to a selected sequence. Each nozzle means 12 therefore includes s solenoid operator 13 connected to a source of electrical power by means of electrical connections that enter the rear portion of the rail means, as through the opening 14 indicated in FIG. 1 of the drawings. The solenoid means 13 and the electrical wiring located or extending from the rear portion of elongated body means 10 is appropriately contained within an enclosure means 15 that is mounted directly onto the rear of body means 10 and extends across the complete length thereof.

The spray rail means and more specifically the elongated body means 10 is designed to be mounted between the left and right hand frames of the printing unit. To accomplish this mounting, means 20 are provided for supporting the body means 10 between the side frames and adjacent the dampener roll. The mounting means 20 includes a mounting bracket 21 which is supported on the press frame. The mounting bracket 20 includes locationing means whereby the elongated body means may be angularly oriented with respect to the dampener roll. The locating means comprises a plurality of holes or openings 22 that are angularly disposed about the center axis of slot 23 that is formed by outwardly extending legs of each mounting bracket 21.

The end of elongated body means receives end plate means 25 that is secured directly to each end of body means 10 by means of suitable fastening devices. Extending outwardly from each end plate means 25 is trunnion means 26 that are effective to support the spray rail means in position adjacent the dampener roll. The trunnion means 26 is received into yoke means 30, this yoke means being an intermediate body that is disposed between trunnion means 26 and the mounting bracket 21. The yoke means 30 comprises a body portion 31 and a pair of diametrically opposed locationing means 32 that take the form of spring biased pins 33. The pins 33 are receivable into the holes 22 that are present in the mounting brackets 21.

Figure 2:
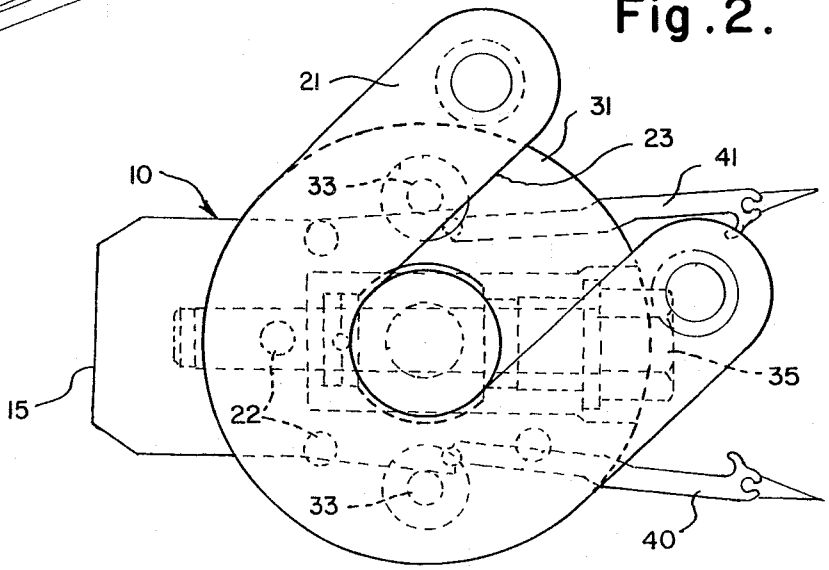
FIG. 2 is an end elevation showing the adjustable mounting of this invention.

Yoke means 30 also includes a threaded element 35 which extends inwardly for engagement on each side of the trunnion means 26. The manner in which interaction is effected between the threaded element 35 and the trunnion is best shown in FIG. 2 of the drawings. By either turning the threaded element to the right or the left, it is possible to move the spray rail either toward or away from the adjoining dampener roll.

In order to confine the spray coming from the nozzles 12 the elongated body means has mounted thereto a pair of elongated spray shields 40 and 41, each of which is provided with an outer edge 40' and 41', respectively, made of an elastomeric material. These spray shields are attached to the body means 10 and extend across the complete width of the body to cooperate with the end plates 25 to define the space within which the fluid spray is confined. The spray shields 40 and 41 are mounted onto body 10 by means of a bracket 42. The bracket has a central web portion 43 and arm portions 44 that extend outwardly therefrom. The ends of arm portions 44 terminate in elements 45 that extend parallel to the length of the spray shields. As can be best seen in FIGS. 4 and 5, the end portions of the arms are receivable into closely complementary slots 46 that are formed a part of each of the spray shields 40 and 41.

A final feature of the spray rail means of this invention are a pair of spray baffles 50. The baffles 50 have an angularly formed inner end 51 that contains a slot through which a threaded fastener 52 extends into the body 10 so that the longitudinal positioning of the spray baffles 50 can be adjusted. By either widening or shortening the distance between baffles 50, the longitudinal distance in which the spray adjacent the ends of the spray rails can travel is restricted.

I claim:

1. Spray rail means for supplying dampening fluid to an offset printing press having a press frame and a dampener roll mounted between side frames, said spray bar means comprising:

a. elongated body means having a fluid passage provided therein for connection to a supply of dampening fluid;

b. a plurality of spray nozzle means disposed along the length of said elongated body means in communication with said fluid passage for spraying dampening fluid against the dampener roll;

c. mounting means for supporting said elongated body means between the side frames adjacent the dampener roll;

d. a pair of elongated spray shields wherein each said spray shield is provided with an inwardly curved lip which defines a channel to collect dampening fluid and prevent it from dripping onto the dampener roll;

e. means mounting said elongated spray shields on said elongated body for movement between an open position permitting access to the press dampener roll and a closed position laterally confining the spray from said nozzles; and f. end plate means secured to each end of said elongated body means longitudinally confining the spray and cooperating with said spray shields and the dampener roll to isolate the spray from the ambient environment.

2. Spray rail means as defined in claim 1 wherein said mounting means for supporting said elongated body means includes a mounting bracket supported on the press frame said mounting bracket including locationing means whereby said spray rail means may be angularly oriented with respect to said dampener roll.

3. Spray rail means as defined in claim 1 including trunnion means extending outwardly from each end of said elongated body means.

4. Spray rail means as defined in claim 3 wherein said trunnion means is formed integrally with and extends outwardly from said end plate means.

5. Spray rail means as defined in claim 1 wherein said mounting means comprises:

(a) a mounting bracket attached to the press frame;

(b) trunnion means extending outwardly from said body means; and (c) support yoke means located between said mounting bracket and said trunnion means to receive said trunnion means and operably support it within said mounting bracket.

6. Spray rail means as defined in claim 5 wherein said mounting bracket includes locationing means and said support yoke means includes means engageable with said locationing means to angularly orient said rail means with respect to said dampener roll.

7. Spray rail means as defined in claim 1 wherein said elongated body means has end spray baffles mounted thereon between said end plate means.

8. Spray rail means as defined in claim 7 wherein said end spray baffles are adjustably mounted on said elongated body means.

9. Spray rail means as defined in claim 6 wherein said means engageable with said locationing means are spring biased pin elements, one end of which is receivable into said locationing means of said mounting means.

10. Spray rail means as defined in claim 1 wherein each said elongated shield is provided with an outer edge of an elastomeric material.

11. Spray rail means as defined in claim 1 wherein said spray shield mounting means comprises a bracket having a central web portion securable to said elongated body, arm portions extending outwardly from said central web portion, and elements on the ends of said arm portions extending parallel to the length of said spray shields for engagement therewith.

12. Spray rail means as defined in claim 11 wherein said spray shields have means defining elongated openings extending parallel to the length thereof and said mounting means elements are pins receivable into said elongated openings.

* * * * *